US005908346A

United States Patent [19]

McCall

[11] Patent Number: 5,908,346

[45] Date of Patent: *Jun. 1, 1999

[54] BRASSIERE AND GARMENT INCORPORATING A BRASSIERE

[76] Inventor: Rita McCall, 28 Kenilworth Square West Rathgar, Dublin 6, Ireland

[ * ] Notice: This patent issued on a continued prosecution application filed under 37 CFR 1.53(d), and is subject to the twenty year patent term provisions of 35 U.S.C. 154(a)(2).

[21] Appl. No.: 08/554,658

[22] Filed: Nov. 8, 1995

Related U.S. Application Data

[63] Continuation-in-part of application No. 08/118,434, Sep. 8, 1993, abandoned.

[51] Int. Cl.[6] ..... A41C 3/00; A41C 1/00; A41D 27/00

[52] U.S. Cl. ..... 450/61; 450/60; 2/73

[58] Field of Search ..... 2/73, 67; 450/3, 450/8, 16, 17, 23, 41, 42, 43, 44, 45, 46, 47, 48, 49, 50, 51, 52, 53, 58, 59, 60, 61, 62, 79, 80, 82, 83, 84

[56] References Cited

U.S. PATENT DOCUMENTS

| | | | |
|---|---|---|---|
| 2,466,638 | 4/1949 | Denis | 450/58 |
| 5,215,494 | 6/1993 | Flanagan | 450/61 |

*Primary Examiner*—Jeanette Chapman
*Attorney, Agent, or Firm*—Scully, Scott, Murphy & Presser

[57] ABSTRACT

A brassiere having a torso encircling bodice (2). A pair of breast cups (10, 11) are attached to the bodice (2). Only each side of a breast cup (10, 11) is attached to the bodice (2) leaving an opening between a lower edge (15, 16) of each breast cup (10, 11) and the bodice (2). Allows freedom of movement for the wearer and improved ventilation.

20 Claims, 12 Drawing Sheets

BRASSIERE AND GARMENT INCORPORATING A BRASSIERE

Figure 1:
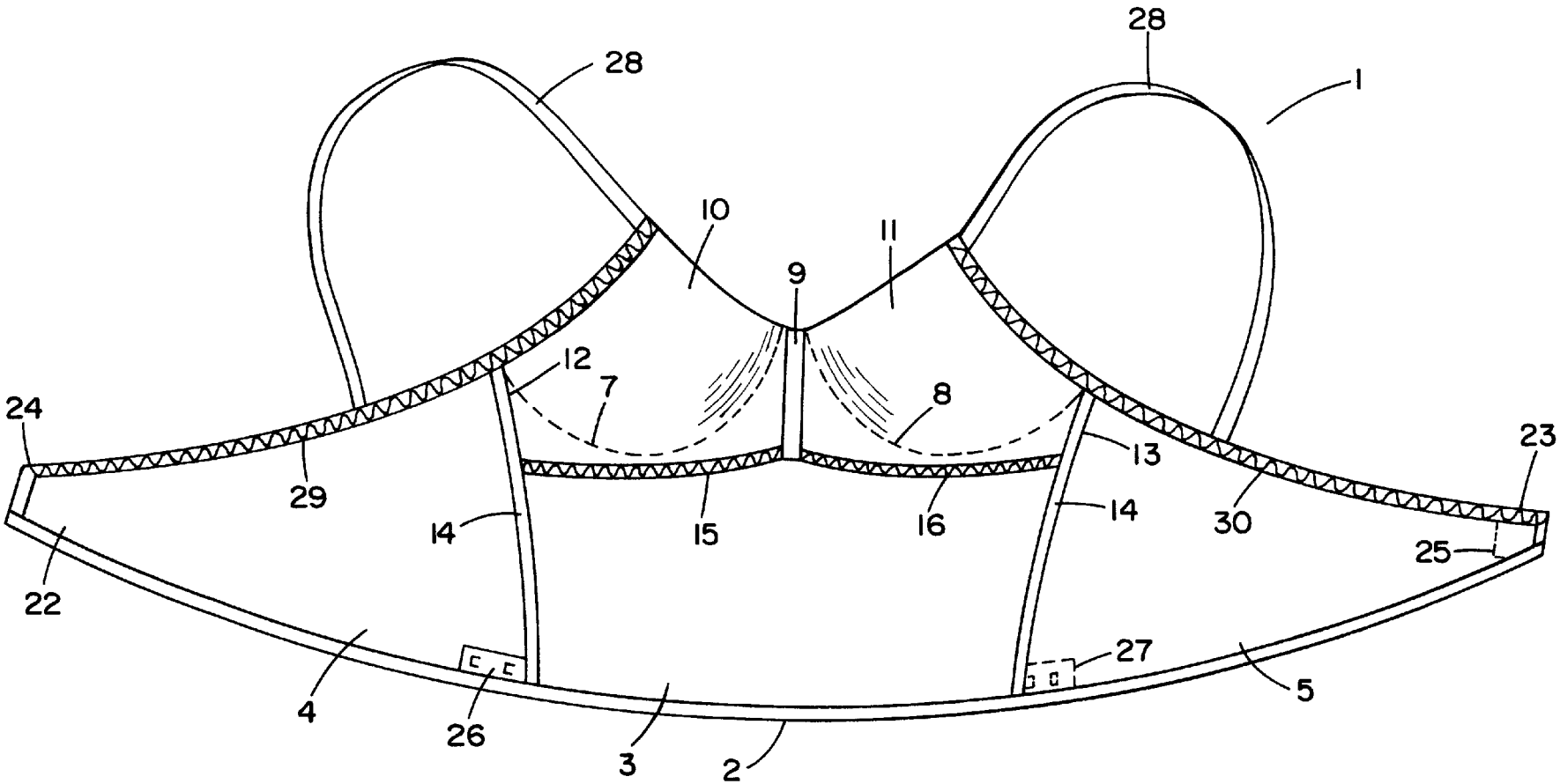

This is a continuation-in-part application of U.S. Ser. No. 08/118,434 filed Sep. 8, 1993, now abandoned, entitled (as amended) A BRASSIERE AND A GARMENT INCORPORATING A BRASSIERE.

The invention relates to improvements to clothing, and in particular to brassieres.

Brassiere typically comprise a torso encircling bodice portion and a pair of breast cuts attached to the bodice, each cup being attached along a lower edge of the cup to the bodice. These garments can be somewhat uncomfortable to wear, for example, if the woman raises her arms overhead the bodice portion tends to ride upwardly and needs to be readjusted subsequently for comfort in normal use.

The present invention is directed towards overcoming this problem.

According to the invention, there is provided a brassiere, comprising a torso encircling bodice and a pair of breast cups attached to the bodice, each cup being attached only at each side of the cup to the bodice thus leaving only an opening between a lower edge of the breast cup and the bodice, a front upper edge of the bodice having two cutout portions for close fitting of the upper edge of the bodice under a wearers breasts with a central tongue between the cut-out portions extending upwardly between the breasts, each cup being attached to the tongue and at an outer side of a cut-out portion at an underarm portion of the bodice.

Preferably, means is provided to open the bodice for ease of fitting on a wearer, fastener means being provided to interconnect associated free ends of the bodice.

In another embodiment, the bodice comprises a front portion and a rear portion formed by back straps attached at each side of the front portion, and fastener means for securing the back straps together to encircle the torso of the wearer with the bodice.

In a further embodiment, a first fastener element is provided at a free end of each strap engageable with a complementary second fastener element on the other strap remote from the free end of the strap, the straps crossing over each other for engagement of the fastener elements.

Preferably, the second fastener element is mounted adjacent each side of the front portion so that each strap extends around the back of the wearer in use.

In another arrangement, each second fastener element is mounted intermediate the ends of a back strap. In this way, only the free ends of the back straps are crossed over and fastened together at either side of the spine of the wearer in use.

Alternatively, complementary fastener elements may be provided at free ends of each strap for interengagement of free ends of the straps. This allows centre fastening of the back straps at the spine of the wearer.

In some cases the brassiere may be of front opening type, the bodice having a front fastening means to open the bodice between the breast cups.

In a further embodiment, a pair of shoulder straps may be provided on the brassiere, each shoulder strap having a front end attached at a top of a breast cup and rear end attached to a rear portion of the bodice adjacent the central part of the rear portion. Thus, advantageously, the rear ends of the shoulder straps are positioned adjacent the spine of the wearer in use for added comfort maintaining the shoulder straps firmly on the shoulders of the wearer in use.

In a preferred embodiment, each breast cup is stitched to the bodice at the tongue and at an underarm portion of the bodice integrally with a stitched seam between the front portion and a back strap.

In another embodiment, one or more support elements are mounted on the brassiere. Preferably, a support element Is mounted along an upper edge of each of the cut-out portions.

In a particularly preferred embodiment, at least one removable support element is mounted on the brassiere. Conveniently, each removable support element is mounted in a pocket having an opening for insertion and removal of the removable support element. Ideally, a retractable flap is mounted across the opening to retain the removable support element within the pocket.

In a further embodiment, a rear portion of the brassiere is formed by a number of triangular panels of material.

In another embodiment, the girth of the brassiere is adjustable, side or rear panels of the brassiere incorporating a folded portion stitched in a folded position by retaining stitches, the folded portion being releasable by removal of the pertaining stitches to extend the width of the panel and hence increase the girth of the brassiere.

In another embodiment, means is provided to open the bodice for ease of fitting on a wearer, fastener means being provided to interconnect associated free ends of the bodice, the fastener means comprising one or more complementary pairs of releasably interengageable magnetic fastener elements. Preferably, the fastener elements comprise a first fastener element and a second fastener element, the first fastener element having a stud releasably engageable within the second fastener element.

In another aspect the invention provides a garment incorporating a brassiere as described above. The brassiere may be incorporated, for example, in corsets, lingerie, body suits, cat suits, basques, strapless and fitted fashion outer garments, swimwear and other foundation garments. It is also envisaged that the brassiere may be adapted for persons wearing a breast prosthesis.

In another aspect, the invention provides a support garment comprising a brassiere as described above in combination with a corset, rear portions of the brassiere and the corset being interconnected with an opening being provided between the front portion of the brassiere and a front portion of the corset. This garment advantageously gives additional support and is particularly suitable for persons with back problems.

Conveniently, one or more copper strips may be mounted on an inside face of the corset. It is believed that this may give relief to persons afflicted with arthritis, rheumatism and the like.

Figure 2:
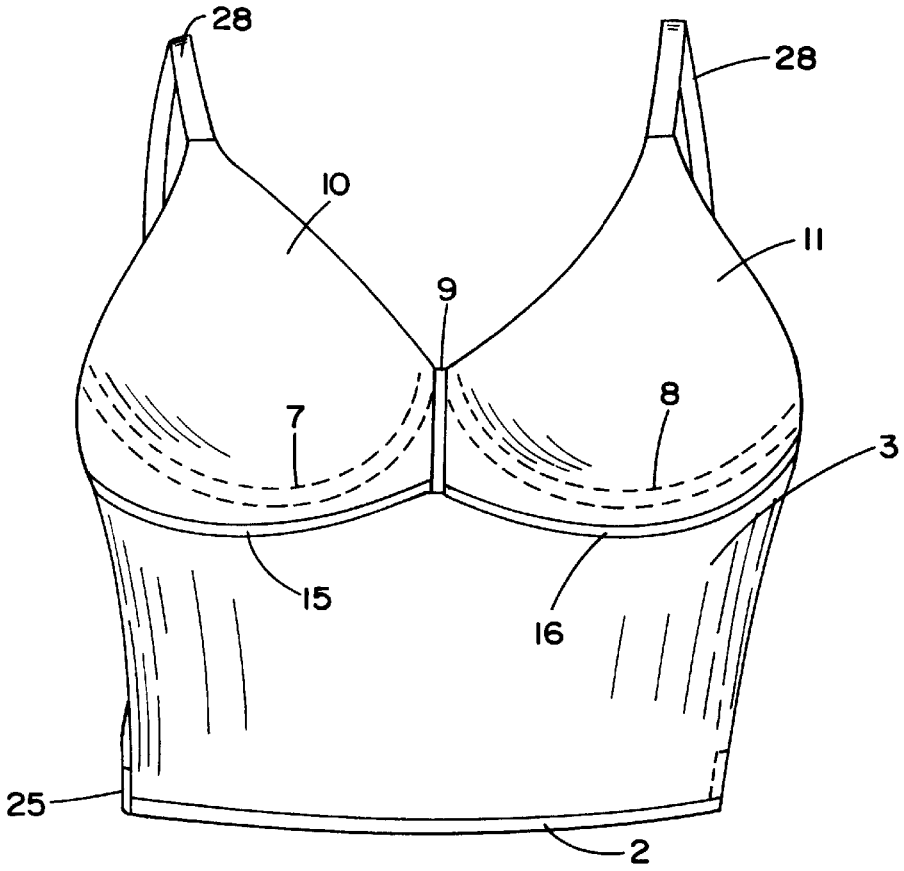
Figure 10:
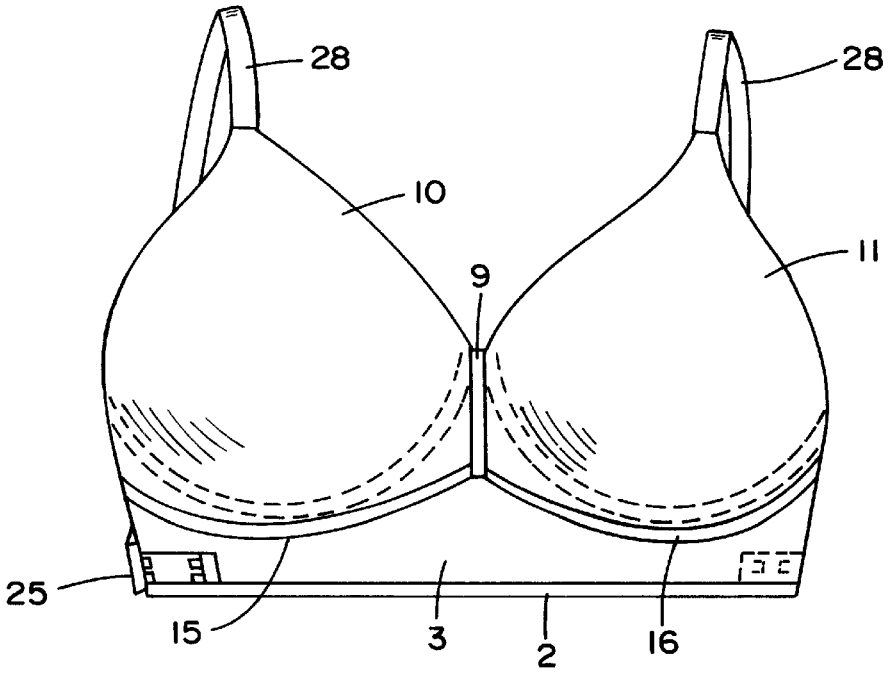
Figure 4:
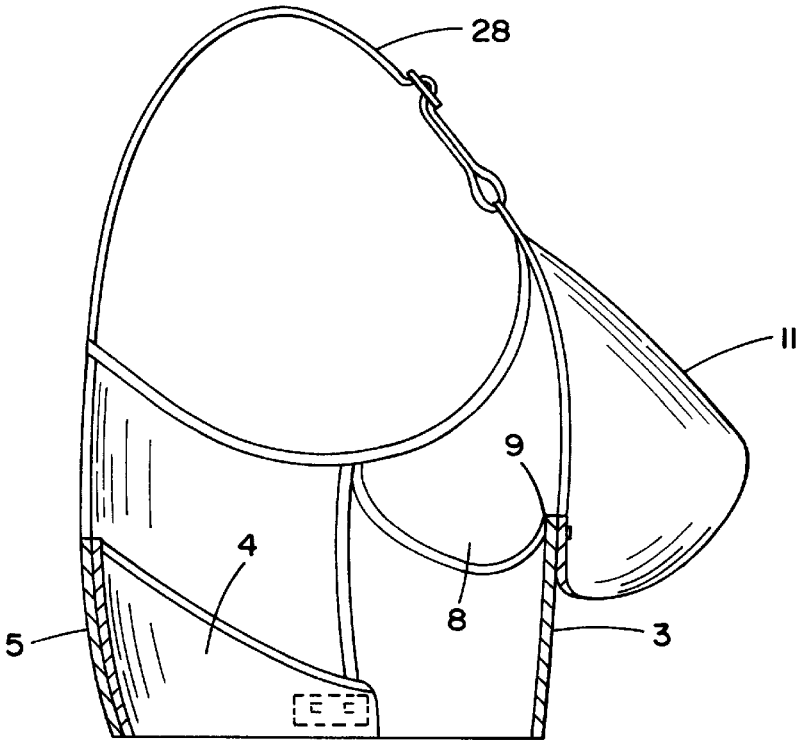
Figure 3:
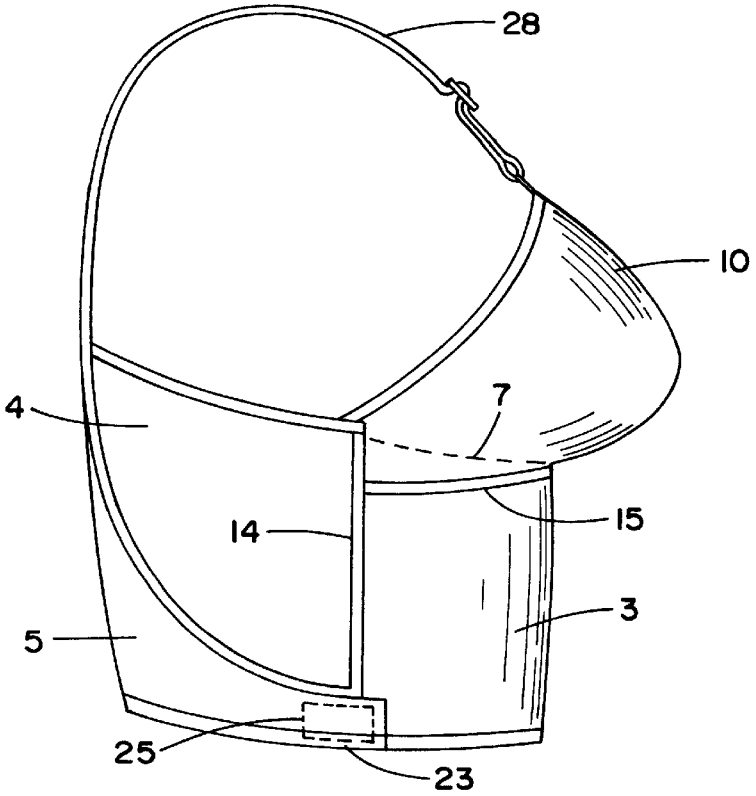
Figure 6:
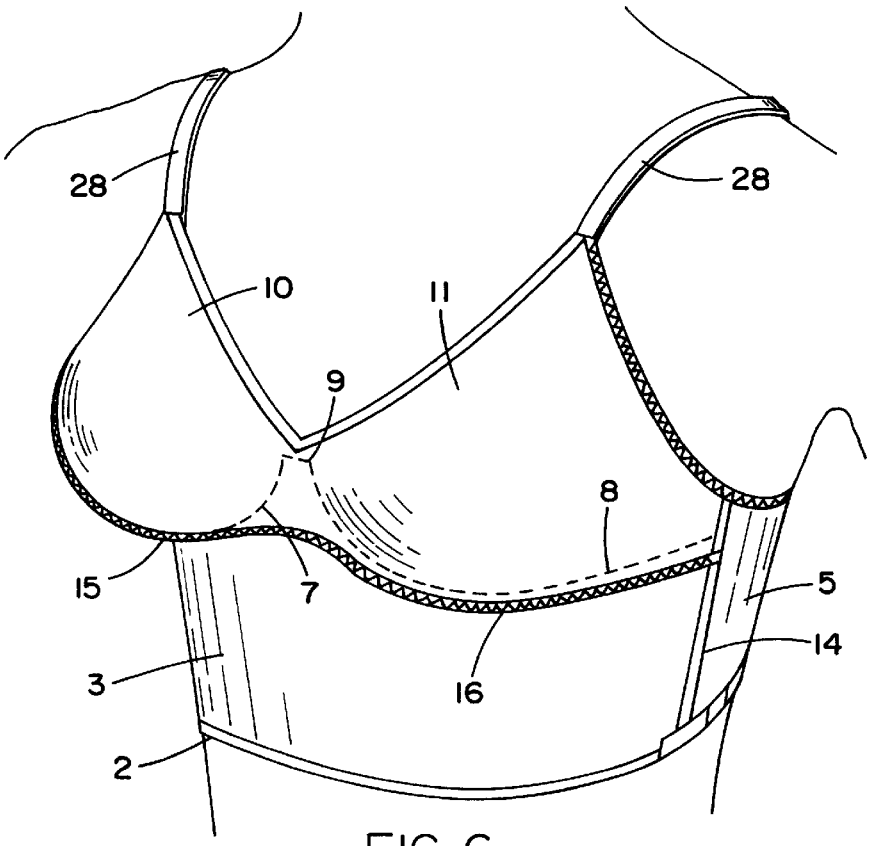
Figure 5:
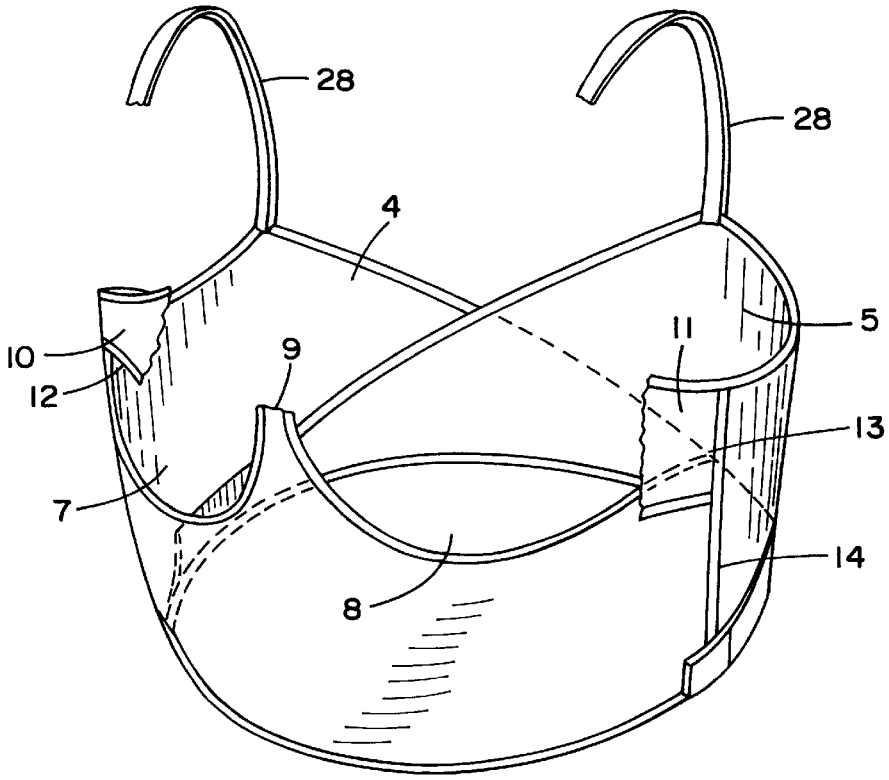
Figure 8:
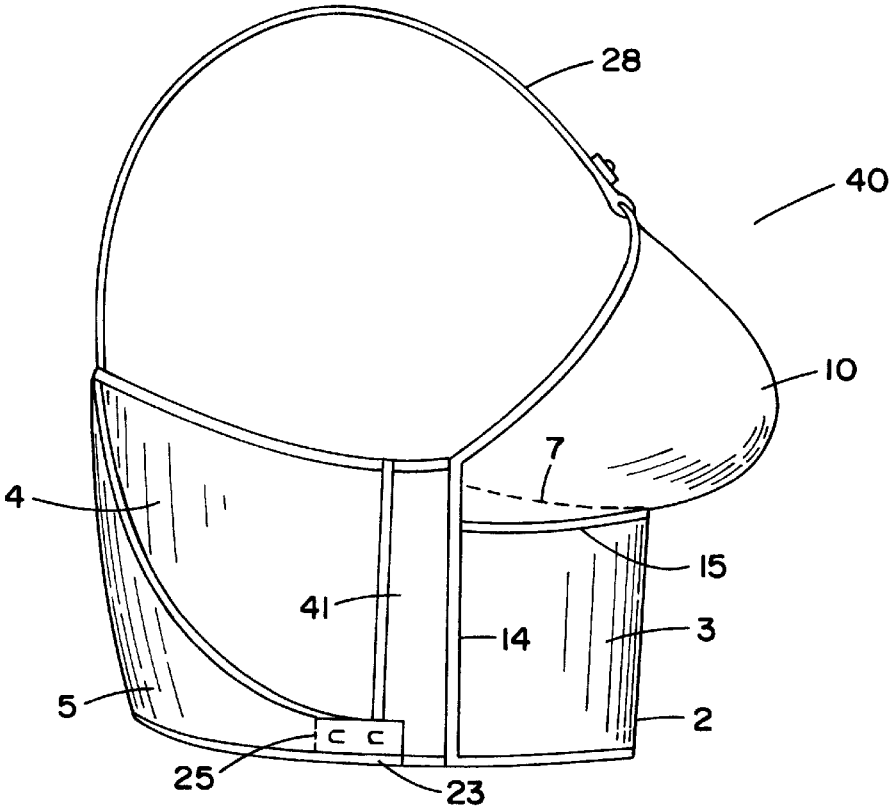
Figure 7:
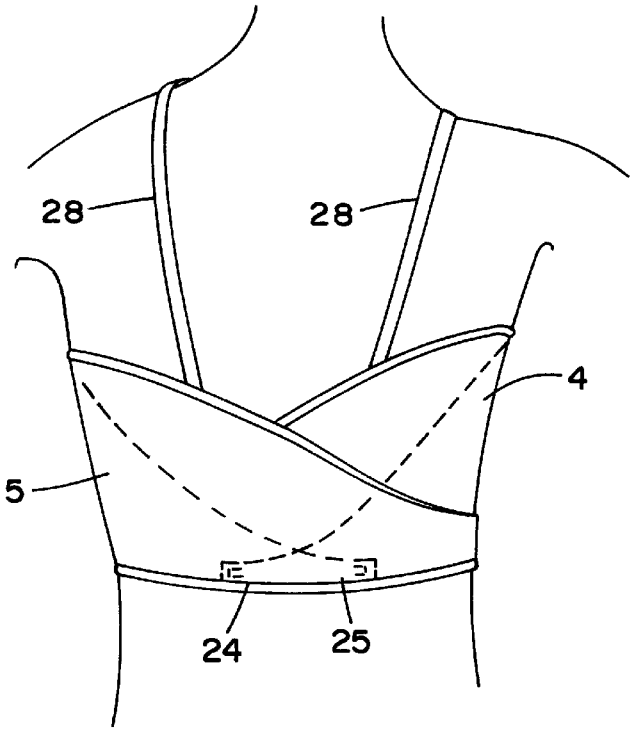
Figure 9:
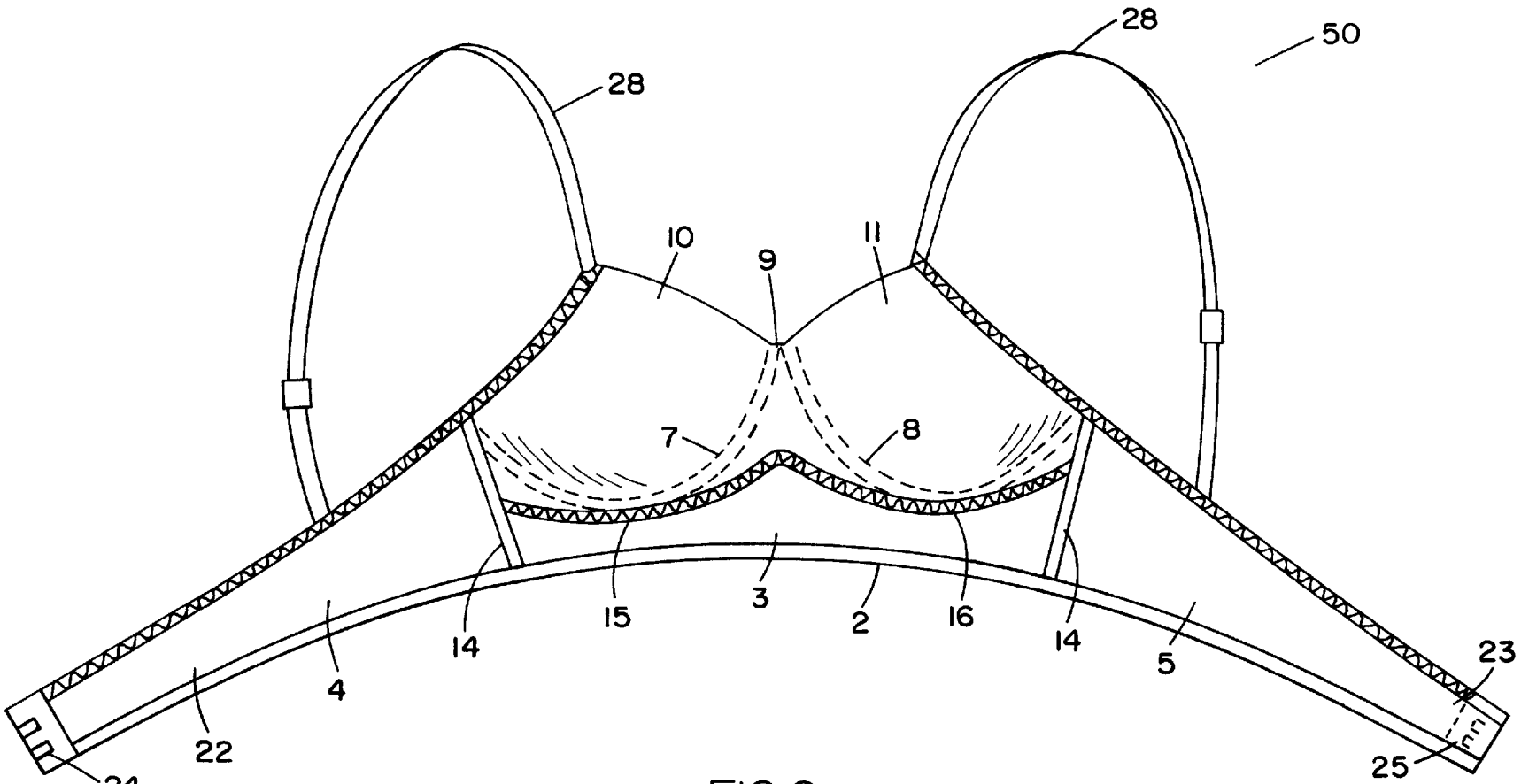
Figure 11:
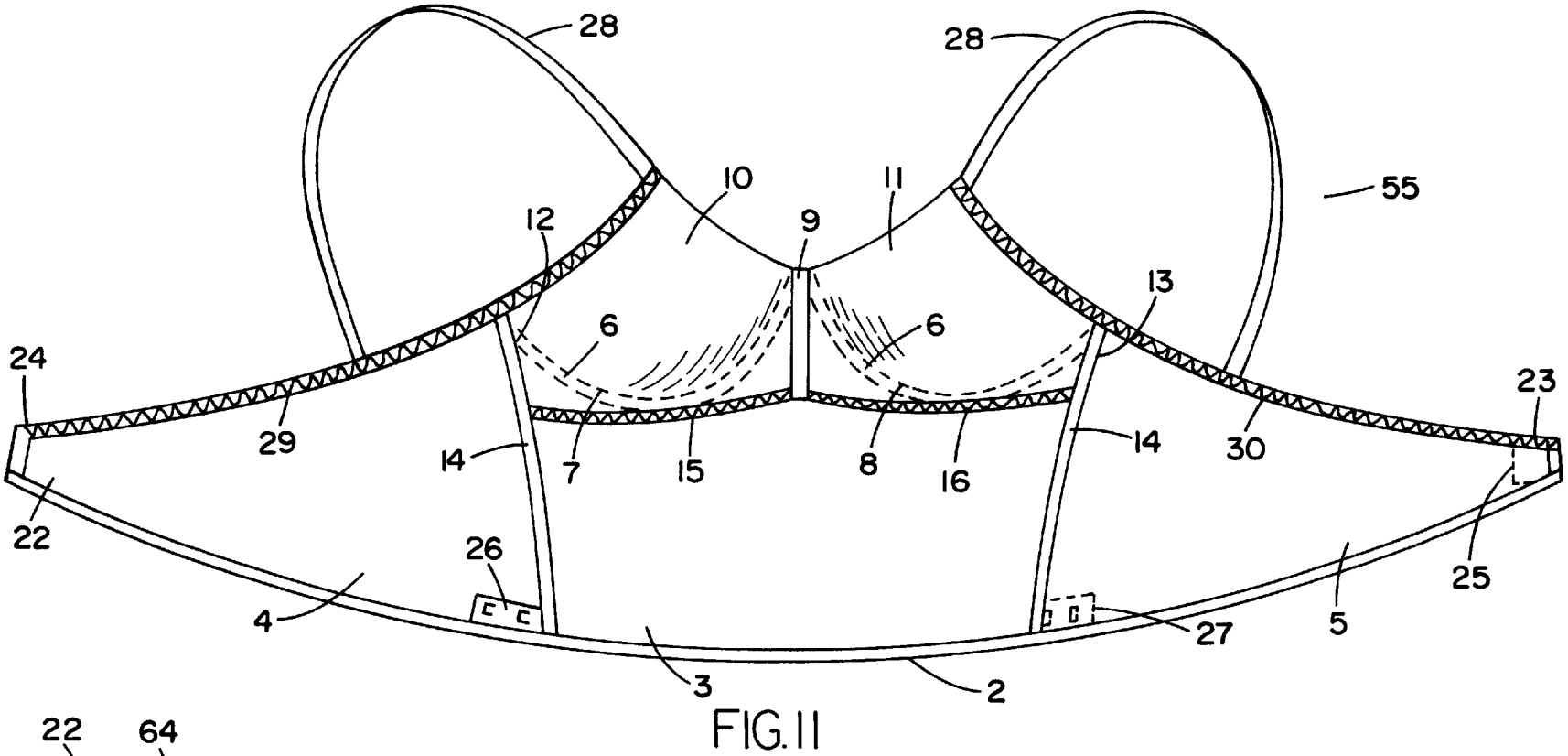
Figure 20:
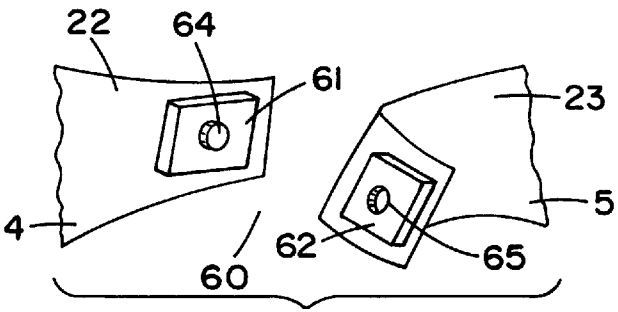
Figure 12:
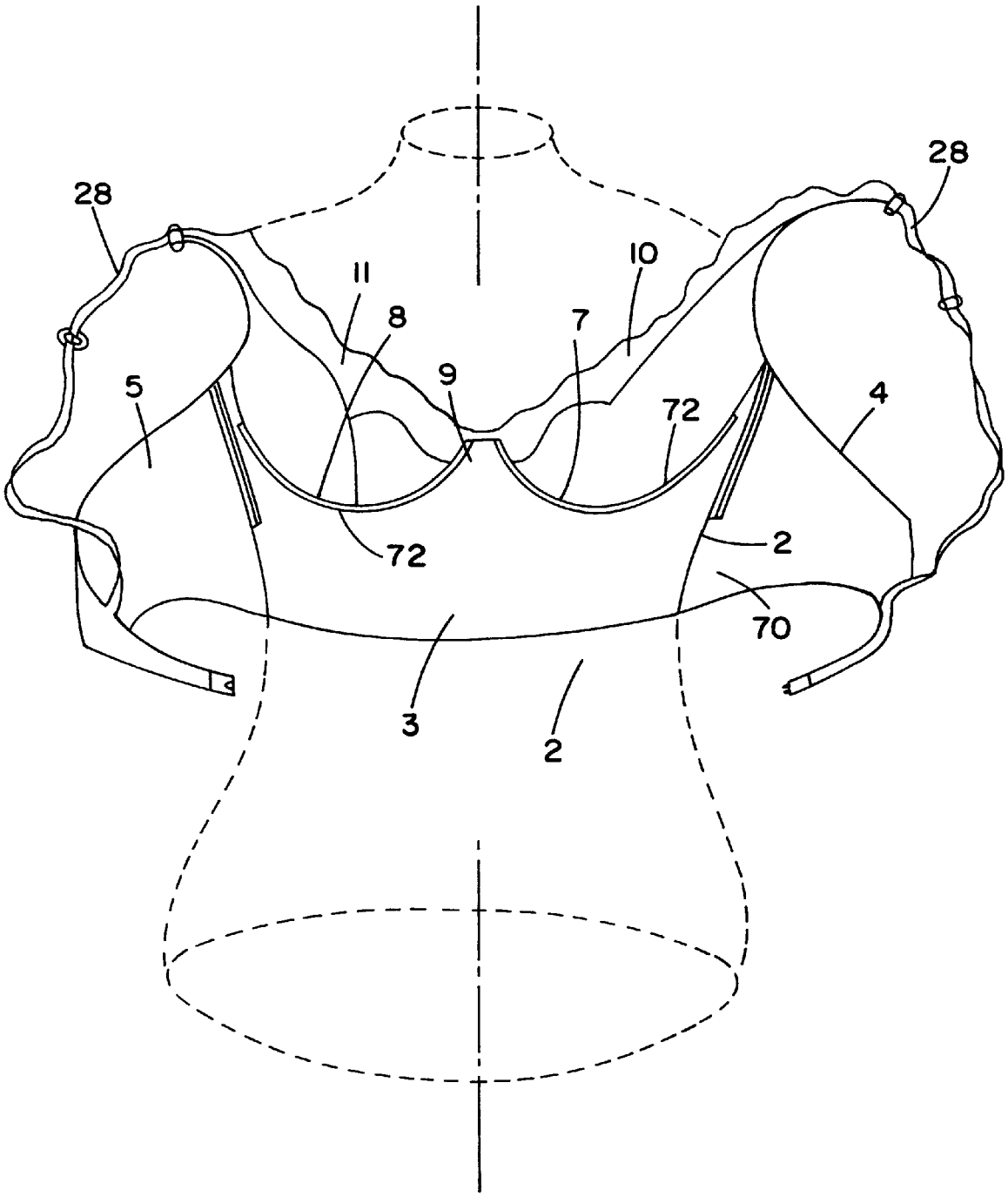
Figure 16:
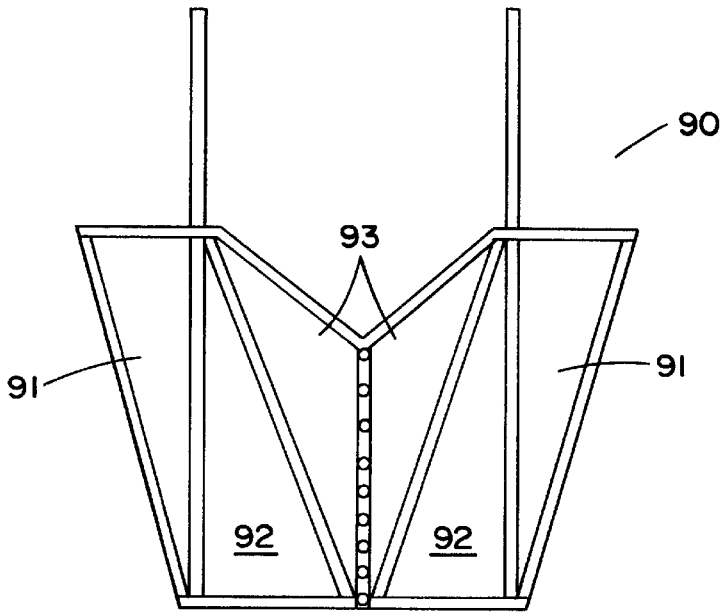
Figure 13:
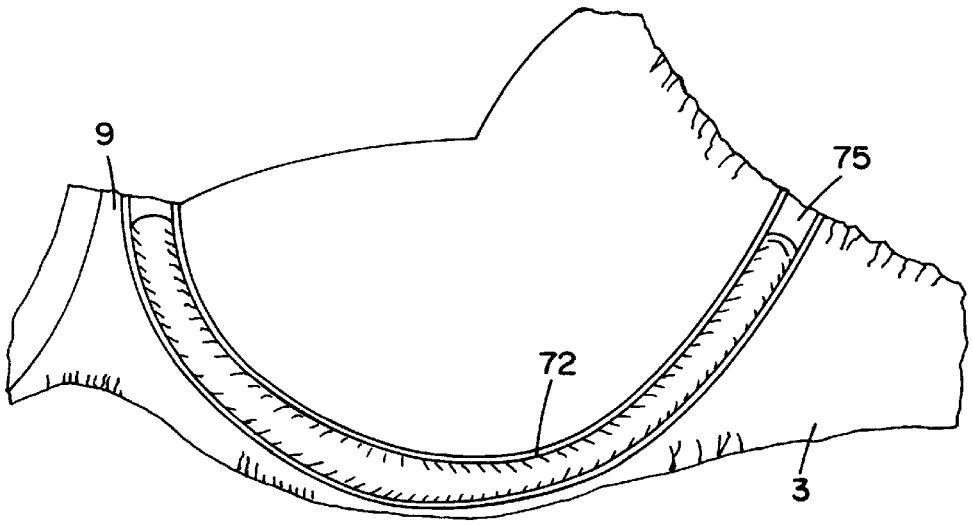
Figure 14:
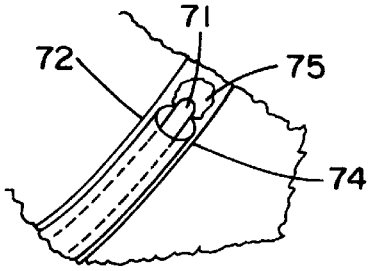
Figure 15:
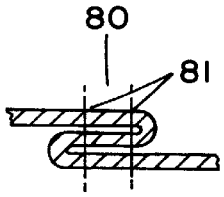
Figure 17:
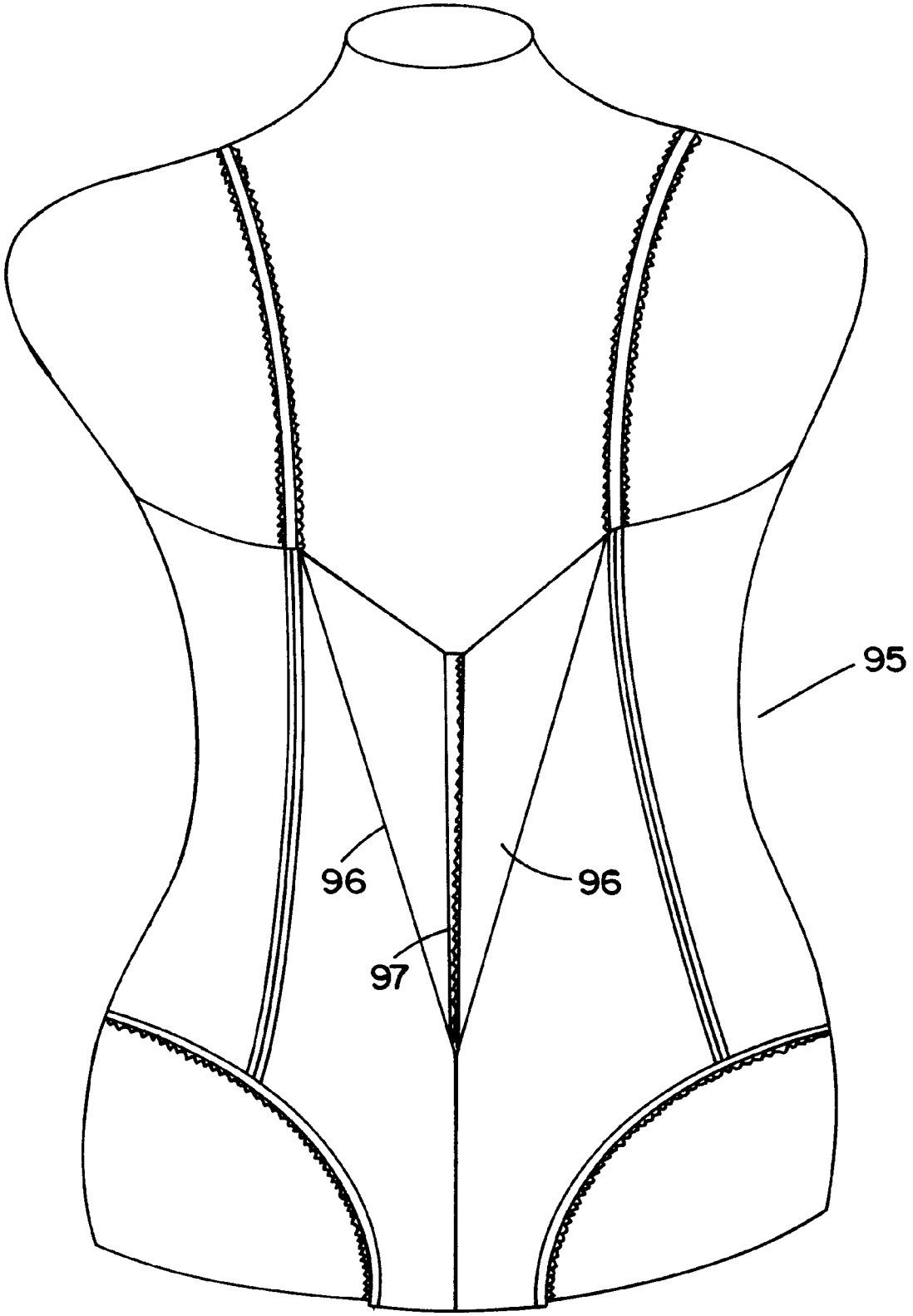
Figure 18:
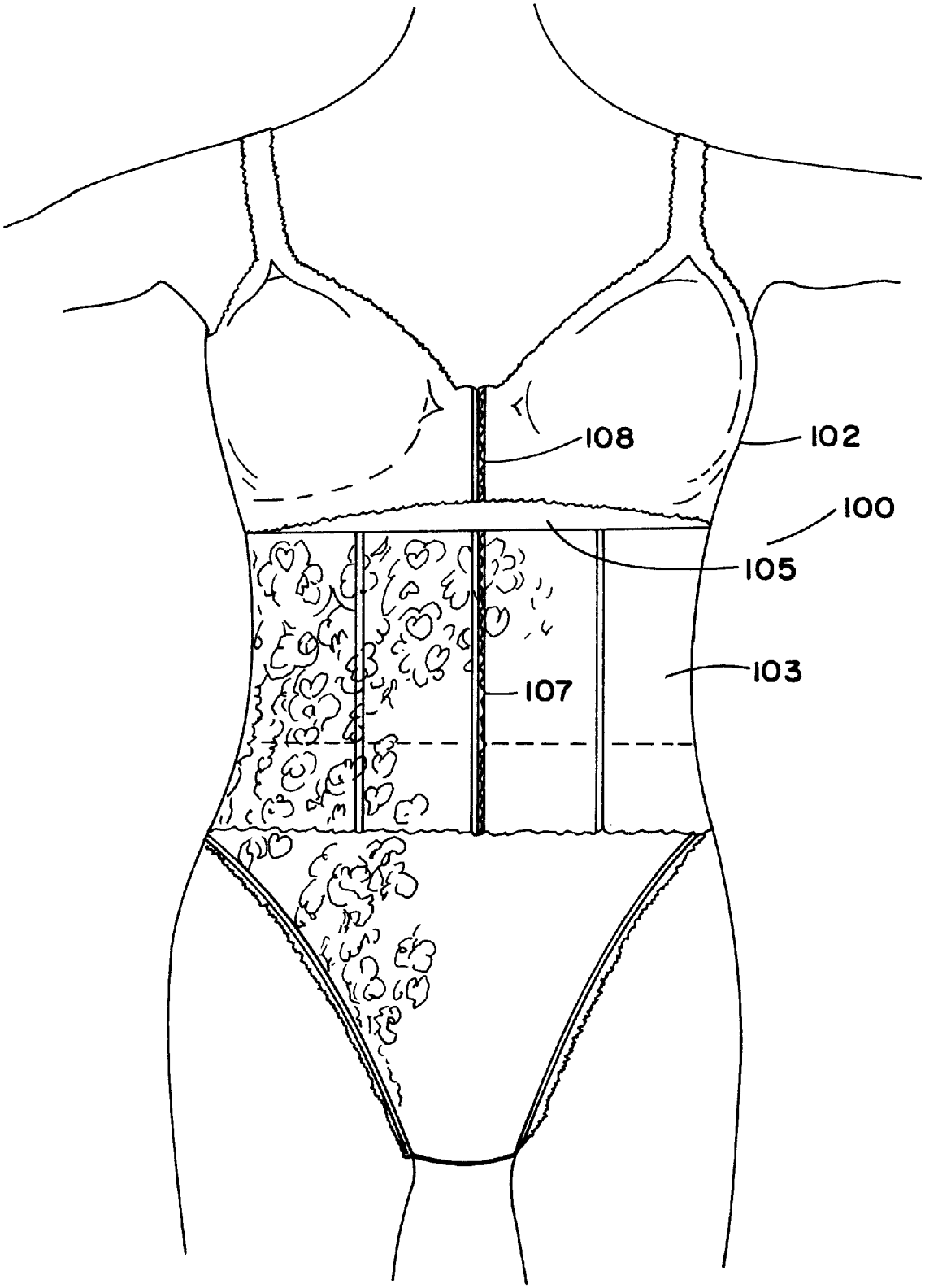
Figure 19:
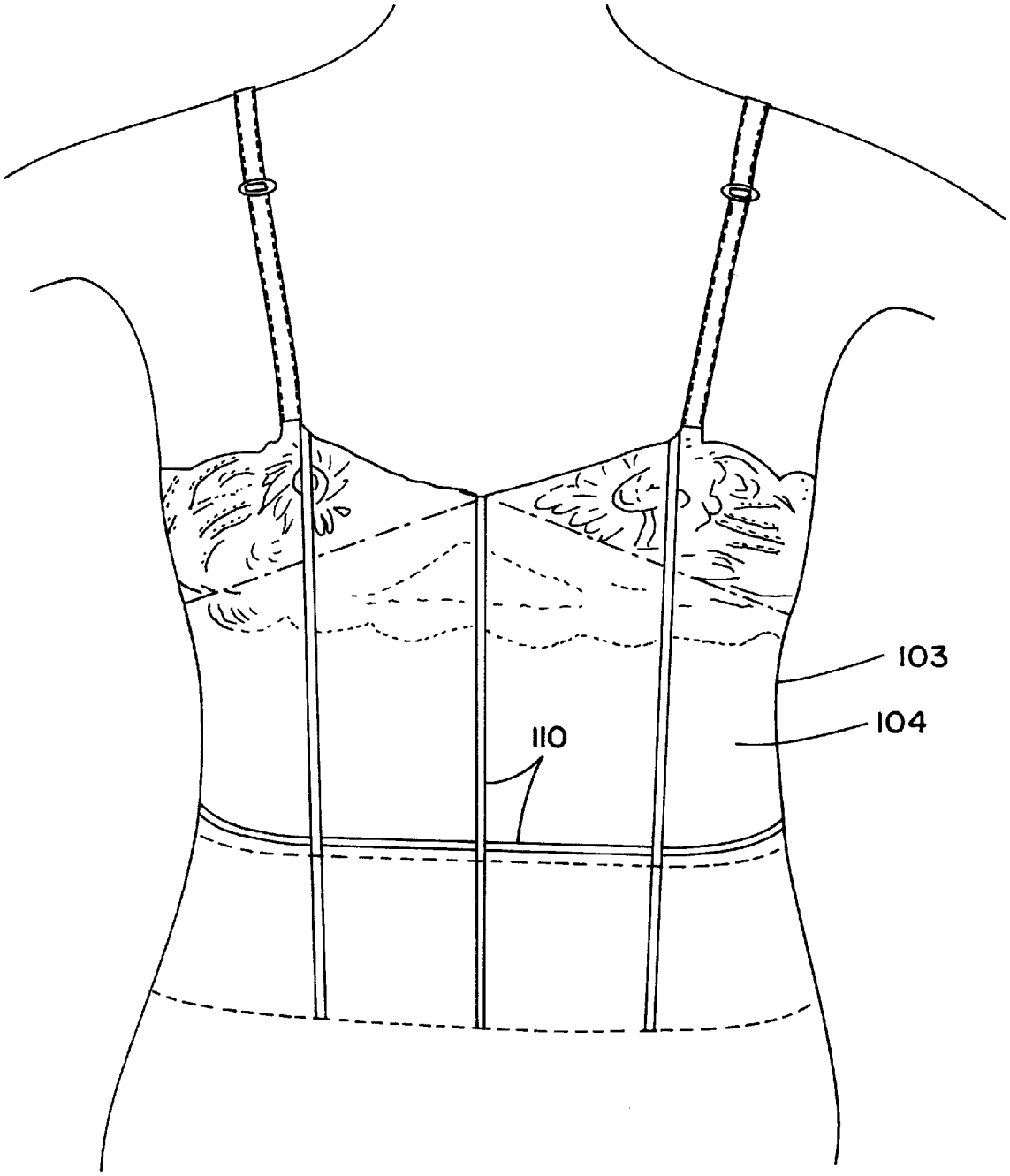

The invention will be more clearly understood by the following description of some embodiments thereof, given by way of example only, with reference to the accompanying drawings, in which:

FIG. 1 is a front elevational view of a brassiere according to the invention fully opened out, FIG. 2 is a front elevational view of the brassiere, FIG. 3 is a side elevational view of the brassiere, FIG. 4 is a side partially sectioned view of the brassiere, FIG. 5 is a perspective, partially cutaway view of the brassiere, FIG. 6 is a front perspective view of the brassiere, in use, FIG. 7 is a rear elevational view of the brassiere in use, FIG. 8 is a side view similar to FIG. 3 of another brassiere according to a second embodiment of the invention, FIG. 9 is a front elevational view of a further brassiere according to a third embodiment of the invention shown in a fully opened position, FIG. 10 is a front elevational view of the brassiere of FIG. 9, FIG. 11 is a view similar to FIG. 1 of a brassiere according to a fourth embodiment of the invention, FIG. 12 is a rear elevational view of another brassiere according to a fifth embodiment of the invention, FIG. 13 is a detail elevational view of portion of a bodice of another brassiere according to a sixth embodiment of the invention, FIG. 14 is a detail elevational view of portion of the bodice of FIG. 13, FIG. 15 is a detail sectional view of an adjustable side seam which may be incorporated in a brassiere according to a seventh embodiment of the invention, FIG. 16 is an elevational view of a back portion of another brassiere according to an eighth embodiment of the invention, FIG. 17 is a rear elevational view of a body suit according to a ninth embodiment of the invention, FIG. 18 is a front elevational view of a combined brassiere and corset garment according to a ninth embodiment of the invention, FIG. 19 is a rear elevational view of the garment shown in FIG. 18, and FIG. 20 is a diagrammatic illustration of an alternative back strap fastener for a brassiere according to a tenth embodiment of the invention.

Referring to the drawings, and initially to FIGS. 1 to 7 thereof, there is illustrated a brassiere according to the invention indicated generally by the reference numeral 1. The brassiere 1 comprises a torso encircling bodice 2 having a front portion 3 with back straps 4, 5 attached at each side of the front portion 3 and forming extensions thereof. An upper edge of the front portion 3 of the bodice 2 has two cut-out portions 7, 8 for close fitting of the front portion 3 under a wearers breasts with a central tongue 9 between the cut-out portions 7, 8 extending upwardly between the breasts as shown in FIG. 6. A pair of breast cups 10, 11 are stitched to the front portion 3 of the bodice 2, each cup 10, 11 being attached to the tongue 9 adjacent a free end of the tongue 9 and at an outer side 12, 13 of each cut-out portion 7, 8. It will be noted that each breast cup 10, 11 in stitched at an underarm portion of the bodice 2 integrally with a seam 14 between the front portion 3 and a back strap 4, 5. Thus an opening is left between a lower edge 15, 16 of each breast cup 10, 11 and the front portion 3 of the bodice 2. The lower edges 15, 16 of the breast cups 10, 11 project downwardly to cover the cut-out portions 7, 8 giving the appearance of a conventional brassiere.

Each strap 4, 5 is generally triangular in shape narrowing from a side seam 14 with the front portion 3 to a free end 22, 23. A first fastener element 24, 25 in provided at the free end 22, 23 of each strap 4, 5 and is engageable with a complementary second fastener element 26, 27 on the other strap 4, 5 remote from the free end 22, 23 of the strap 4, 5. In this case the second fastener element 26, 27 is mounted adjacent the seam 14 between the strap 4, 5 and the front portion 3 at a lower end of the strap 4, 5. It will be noted that one of the second fastener elements 26 is mounted on an outer side of the strap 4 and the other second fastener element 27 is mounted on an inner side of the strap 5. Thus, the straps 4, 5 can be crossed over each other to interengage the fastener elements 24, 25, 26, 27.

Shoulder straps 28 are provided extending between a top of each breast cup 10, 11 and an upper edge 29, 30 of each strap 4, 5. The shoulder straps 28 are length adjustable in conventional fashion. It will be noted that the shoulder straps 29 are attached to the back straps 4, 5 sat a position such that in use rear ends of the shoulder straps 28 are positioned adjacent the spine of the wearer to ensure the shoulder straps 28 are firmly held on the shoulders of the wearer.

In use, the brassiere 1 is worn in similar fashion to a conventional brassiere. However, the fact that lower edges of the breast cups 10, 11 are not connected to the bodice 2 allows greater freedom of movement for the user, the bodice not being pulled out of position even when the wearer raises here arms above shoulder height. Since the front portion 3 of the bodice 2 is shaped for the area immediately under the breasts it is held firmly in place and the breast cups 10, 11 can move to accommodate arm and shoulder movements. It will be noted that each breast cup is only attached at each side of the cup to the bodice thus leaving only an opening between a lower edge of the breast cup and the bodice. Further, the front portion of the bodice hugs the wearer's body lying flat against the rib cage of the wearer with a central tongue between the cut-out portions extending upwardly between the breasts.

A further advantage of the brassiere is the improved ventilation it gives to the breasts of the wearer making it more comfortable for the wearer.

The cross-over arrangement of the back straps gives an attractive line under clothing as it is smooth with no fasteners protruding, which is particularly advantageous when wearing delicate materials. It is very comfortable for the wearer and because of the low cut at the back allows good ventilation to the back of the wearer. Also low backed dresses or tops can be worn.

It will be appreciated that while a crossover back strap arrangement has been shown, any other type of fastening may be used such an a central back fastening or a front fastening arrangement. FIG. 7 also shows in broken outline an alternative fastening arrangement whereby free ends of the back straps 4, 5 cross-over and are fastened at each side of the spine of the wearer.

FIG. 8 shows another brassiere 40 similar to the brassiere of FIGS. 1 to 7 and like parts are assigned the same reference numerals. In this case an additional gusset 41 is provided between the front portion 3 and each back strap 4, 5. The gusset may be of any desirable width or may be divided into smaller sections joined by seams.

FIGS. 9 and 10 show another brassiere 50 similar to the brassiere of FIGS. 1 to 7 and like parts are assigned the same reference numerals. In this case, the brassiere 50 is a short line brassiere and the front portion 3 and back straps 4, 5 are of shorter depth than in the brassiere illustrated in FIGS. 1 to 7 which is in the form of a long line brassiere. This short brassiere is particularly suited for sporting activities. It may have a brief bodice section or drop down over the upper torso of the wearer.

It is also envisaged that a brassiere according to the invention may be incorporated in other garments, such as body suits, slips, corsets, basques and the like foundation garments and also swimsuits.

The brassiere and garments incorporating the brassiere may be made of any suitable materials. The breast cups may be provided with in-built support where necessary, so also the bodice depending on the style of the garment.

The front portion 3 may consist of one complete piece of material or it may be cut in sections and joined by seams to either strengthen or enhance the appearance.

Seams in the bodice and relating to the joining of the back straps may be rearranged for varied styling.

The brassiere when worn, gives the appearance of a conventional brassiere, the cut-out portions under the breasts not being obvious.

It will be appreciated that the brassiere may be any suitable style, not just the basic style illustrated in the drawings.

Advantageously, the brassiere is stabilised on the body of the wearer due to the bodice hugging the body of the wearer whilst being shaped closely under the bust and contouring on upwards between both breasts narrowing to end between the breasts.

The breast cups are permanently stitched to the bodice at the tongue which extends between the breasts and on either side of the garment under each arm becoming an integral part of the complete garment. When the breast cups are stitched to the bodice under the arms, it becomes one seam combining the breast cups and bodice and thus the front and back of the complete garment merge.

The variety and styling of the breast cups is unlimited. The front portion of the bodice section whilst retaining the basic feature of stabilising the garment on the body may be cut and joined in sections or not, or adorned with diagonal or other stitching to improve the professional look, or to offer stronger midriff control if necessary. This will not depart from the basic design. It may be lined or not depending on the material used and category for which it is intended.

A particularly advantageous feature of the invention, is the ventilation afforded to the body (as compared to a conventional brassiere) due to the division between the breast cups and the bodice. In long line brassieres the controlling benefit of a long line brassiere is achieved whilst improving the comfort for the wearer.

The back section of the garment is also designed to give maximum comfort with attractive diagonal cross-over straps which fasten adjacent the side seams.

Shoulder straps can be varied in style, and in any suitable materials. In some cases, a strapless brassiere may be provided.

Referring now to FIG. 11, there is illustrated another brassiere according to a fourth embodiment of the invention indicated generally by the reference numeral 55. Parts similar to those of the brassiere described with reference to FIGS. 1 to 7 are assigned the same reference numerals. In this case, a pair of curved wire support elements 6 are mounted within sealed pockets on the bodice 2 extending along an edge of each of the cut-out portions 7, 8. The underwiring provided by the wire support elements 6 provide added support for the wearer whilst providing a close fit and comfort for the wearer. It will be noted that the wire support elements are inserted in the bodice section of the brassiere in the cut-away section under the breasts as distinct from conventional brassieres in which wire supports are placed in the lower section of the breast cups. Thus advantageously, with the brassiere of the present invention, the wire will always stay in place as it is wedged beneath the breasts in the bodice section ensuring a comfortable and perfect fit. Since the wire support is in the bodice section which is only joined to the breast cups at each side of the breast cups, this leads the breast cups to encase the breasts without the softness of the breast cup material becoming rigid ensuring proper comfort.

Referring now to FIGS. 12 to 14, there in illustrated another brassiere according to the invention and indicated generally by the reference numeral 70. Parts similar to those of the brassieres described previously are assigned the same reference numeral. In this case, a pair of removable wire support elements 71 arm mounted in pockets 72 formed along an upper edge of each of the cut-out portions 7, 8. Each pocket 72 has an opening 74 at one end of the pocket 72 for insertion and removal of the removable wire support elements 71. A retractable flap 75 is mounted across the opening 74 to retain the removable wire support elements 71 within the pocket 72. Advantageously, a user simply retracts the flap 75 for removal or insertion of support wires 71.

Referring now to FIG. 15, there is shown portion 80 of a side or rear panel for a brassiere which allows adjustment of the girth of the brassiere. It will be noted that the panel portion 80 is folded over on itself and held in the folded position by retaining stitches 81. To increase the girth of the brassiere, the user simply releases the stitching 81 so that the fold can be opened out to extend the width of the panel. This simple adjustment means can be readily easily incorporated in any brassiere and allows one brassiere to be adjusted to accommodate different wearers.

Referring now to FIG. 16, there is illustrated a rear portion 90 of another brassiere. In this case, the rear portion is formed by a number of interconnected triangular panels 91, 92, 93 of material. This configuration advantageously minimises the gathering up which frequently occurs at the waist of the wearer due to the indentation at the spinal area. It will be noted that central triangular panels 93 taper outwardly from a narrowed lower end.

Referring to FIG. 17, there is shown a body suit 95 incorporating the triangular back panel configuration. In this case, the body suit 95 has central triangular back panels 96 on either side of a line of fasteners 97 for more comfortable fitting of the garment at the user's back.

Referring now to FIGS. 18 and 19, there is shown a support garment according to the invention indicated generally by the reference numeral 100. The garment 100 comprises a brassiere 102 of the type previously described in combination with a corset 103. As can be seen in FIG. 19, rear portions of the brassiere 102 and corset 103 are interconnected forming a unified rear portion 104 of the garment 100. An opening 105 is provided between the front portion of the brassiere 102 and a front portion of the corset 103. The garment 100 is of the front-opening type with a line of fasteners 107, 108 in the centre of the front portion of the brassiere 102 and corset 103.

In use, a wearer can put on the garment in similar fashion to a jacket with the wearer's arms inserted through the straps, the bodice of the brassiere 102 and the corset 103 being wrapped around the torso and secured by means of the fasteners 107, 108. It will be noted that the brassiere portion 102 gives the same support and freedom as previously described and in this case, additional support is provided in that the straps transfer the weight of the breasts onto the corset portion 103. The brassiere 102 is not pulled out of shape as there is no connection between the front of the brassiere 102 and the front of the corset 103.

FIG. 19 also shows strips of copper woven fabric 110 mounted on an inside face at a rear of the corset 103 for positioning at the spinal column and across the back in the area of the hips from side to side. The strips 110 are an optional addition to the garment to aid persons with arthritis, rheumatism or the like conditions.

Referring now to FIG. 20, there is illustrated an alternative fastener arrangement 60 for the brassieres. Parts similar to those previously described are assigned the same reference numerals. The fastener arrangement 60 comprises a complementary pair of releasably interengageable magnetic fastener elements, namely a first fastener element 61 mounted at the free end 22 of the strap 4 and a second fastener element 62 mounted at the free end 23 of the strap 5. The first fastener element 61 has a stud 64 which is releasably interengageable with a complementary socket 65 in the second fastener element 62. It will be appreciated that the magnetic fastener elements 61, 62 facilitate ease of fastening and release of the garment by the user.

Brassieres according to the invention may be made of any suitable materials.

The invention is not limited to the embodiments hereinbefore described which may be varied in both construction and detail.

I claim:

1. A brassiere comprising:

a torso encircling bodice, means for securing the bodice about a wearer's torso and a pair of breast support cups attached to the bodice;

said bodice having a front portion and a rear portion, said front portion having a front upper edge having two cut-out portions for close fitting of the upper edge of the bodice under a wearer's breasts, and a central tongue between the cut-out portions extending upwardly between the breasts, said rear portion extending around the back of the wearer in use;

each of said breast support cups being attached only to the tongue of the bodice at an inner side of a cut-out portion and at an outer side of the cut-out portion at an underarm portion of the bodice, thus leaving an opening between a lower edge of the breast cup and the bodice.

2. A brassiere as claimed in claim 1 wherein said back portion includes first and second free end portions and said means for securing the bodice comprises a fastener means which is provided to open the bodice for ease of fitting on a wearer and to interconnect said first and second free ends of the bodice.

3. A brassiere as claimed in claim 1 wherein said rear portion is formed by back straps attached at each side of the front portion, and said means for securing the bodice comprises fastener means for securing the back straps together to encircle the torso of the wearer with the bodice.

4. A brassiere as claimed in claim 3 wherein a first fastener element is provided at a free end of each strap engageable with a complementary second fastener element on the other strap remote from the free end of the strap, the straps crossing over each other for engagement of the fastener elements.

5. A brassiere as claimed in claim 4 wherein the second fastener element is mounted adjacent each side of the front portion.

6. A brassiere as claimed in claim 4 wherein each second fastener element is mounted intermediate the ends of a back strap.

7. A brassiere as claimed in claim 3 wherein complementary fastener elements are provided at a free end of each strap for interengagement of free ends of the straps.

8. A brassiere as claimed in claim 1 wherein the bodice has a front fastening means to open the bodice between the breast cups.

9. A brassiere as claimed in claim 1 having a pair of shoulder straps, each shoulder strap having a front end attached at a top of a breast cup and a rear end attached to a portion of the bodice adjacent a central part of the back portion.

10. A brassiere as claimed in claim 1 wherein a support element is mounted along an upper edge of each of the cut-out portions.

11. A brassiere as claimed in claim 10 wherein at least one removable support element is mounted on the brassiere.

12. A brassiere as claimed in claim 11 wherein each removable support element is mounted in a pocket having an opening for insertion and removal of the removable support element.

13. A brassiere as claimed in claim 12 wherein a retractable flap is mounted across the opening to retain the removable support element within the pocket.

14. A brassiere as claimed in claim 1 wherein said back portion of the brassiere is formed by multiple triangular panels of material.

15. A brassiere as claimed in claim 1 wherein said brassiere has a girth which is adjustable and said brassiere further comprises side or rear panels, said side or rear panels of the brassiere incorporating a folded portion stitched in a folded position by retaining stitches, the folded portion being releasable by removal of the retaining stitches to extend the width of the panel and hence increase the girth of the brassiere.

16. A brassiere as claimed in claim 1 wherein said means for securing the bodice comprises a fastener means comprising one or more complementary pairs of releasably interengageable magnetic fastener elements.

17. A garment incorporating a brassiere as claimed in claim 1.

18. A support garment comprising a brassiere as claimed in claim 1 in combination with a corset, said corset comprising a front portion and a rear portion, said rear portion of the bodice and said rear portion of the corset being interconnected with an opening being provided between the front portion of the bodice and the front portion of the corset.

19. A support garment as claimed in claim 18 wherein said corset includes an inside face and one or more copper strips are mounted on said inside face of the corset.

20. A brassiere as claimed in claim 1 wherein said rear portion is formed by back straps attached at each side of the front portion and each breast cup is stitched to the bodice at the tongue and at an underarm portion of the bodice integrally with a stitched seam between the front portion and a back strap.

* * * * *